US005961308A

United States Patent [19]

Nakano

[11] Patent Number: 5,961,308

[45] Date of Patent: Oct. 5, 1999

[54] CYLINDRICAL PUMP DEVICE HAVING A FLEXIBLE BLADE MEMBER

[75] Inventor: Masashi Nakano, Niigata, Japan

[73] Assignee: NEC Corporation, Tokyo, Japan

[21] Appl. No.: 08/879,512

[22] Filed: Jun. 20, 1997

[30] Foreign Application Priority Data

Jun. 20, 1996 [JP] Japan ..... 8-159337

[51] Int. Cl.[6] ..... F01C 5/00

[52] U.S. Cl. ..... 418/153; 418/161

[58] Field of Search ..... 418/56, 61.1, 153, 418/154, 156, 161

[56] References Cited

U.S. PATENT DOCUMENTS

| | | | |
|---|---|---|---|
| 3,410,219 | 11/1968 | Shope | 418/153 |
| 4,004,865 | 1/1977 | Ikeda et al. | 418/153 |
| 4,334,842 | 6/1982 | Ikeda et al. | 418/153 |

FOREIGN PATENT DOCUMENTS

| | | |
|---|---|---|
| 3-187762 | 8/1991 | Japan . |
| 6-8473 | 1/1994 | Japan . |
| 6-47922 | 2/1994 | Japan . |
| 7-60981 | 3/1995 | Japan . |

*Primary Examiner*—Charles G. Freay
*Attorney, Agent, or Firm*—Foley & Lardner

[57] ABSTRACT

A cylindrical pump device comprises a cylindrical housing and a cylindrical rotational member disposed in the cylindrical housing for rotation around the axis of the cylindrical housing. The cylindrical rotational member has a solid cylindrical wall, a central hub and a plurality of flexible blades extending between the central hub and the solid cylindrical wall for defining a plurality of liquid chambers therebetween. The cylindrical housing supports a shaft apart from the central axis of the cylindrical housing. During rotation of he rotational member, the chambers far from the central axis first increases its volume to introduce liquid ink therein and then decreases its volume to discharge the liquid ink from the chamber. Inlet valve or outlet valve for the pump are not necessary to reduce the parts and fabrication cost of a pump system.

9 Claims, 9 Drawing Sheets

CYLINDRICAL PUMP DEVICE HAVING A FLEXIBLE BLADE MEMBER

BACKGROUND OF THE INVENTION (a) Field of the Invention

The present invention relates to a cylindrical pump device having a flexible blade member and, more particularly, to a cylindrical pump device suitably used in an ink jet recording device.

(b) Description of the Related Art

In an ink jet recording device, after discharging liquid ink for a certain amount of time in succession, bubbles are formed in an ink passage in the ink jet recording head. The bubbles become obstacles against the discharge of the liquid ink from the nozzle of the recording head to thereby degrade the printing quality of the ink jet recording device. To avoid such a degradation in the printing quality, a pump system is generally installed in the ink jet recording device to discharge, periodically or upon request, the bubbles together with the liquid ink from the ink jet recording head.

A conventional pump system such as shown in FIG. 1 is generally used in an ink jet recording device. The pump system is installed between an ink jet recording head 12 and an ink reservoir 21, and includes a plunger pump 11 and a pair of valves 13 and 15 disposed between the inlet port of the plunger pump 11 and the ink jet recording head 12 and between the outlet port of the plunger pump 11 and the ink reservoir 21, respectively.

In operation, the plunger pump 11 is first started for operation with the inlet valve 13 and outlet valve 15 being closed and opened, respectively, to allow the air remaining in the plunger pump 11 to be discharged to the ink reservoir 21 through tubes 19 and 20. The pump 11 is stopped, and then restarted after inlet valve 13 and outlet valve 15 are opened and closed, respectively, to pull out the bubbles together with liquid ink in the nozzle of the recording head 12 through the tube 16 and 17 to the pump 11. Then, the pump 11 is again stopped, and restarted after inlet valve 13 and outlet valve 15 are closed and opened, respectively, to allow the bubbles and liquid ink to be discharged to the ink reservoir 21. The operations are periodically repeated for several times to discharge the bubbles together with the liquid ink from the ink jet recording head 12 to the ink reservoir 21.

The conventional pump system as used in an ink jet recording head has a disadvantage that the pump system has a complicated configuration due to the pair of valves and suffers from a complicated operation, as described above.

SUMMARY OF THE INVENTION

It is an object of the present invention to provide a pump device which can be used alone without valves and provide a pump system having a reduced number of parts and thus achieving a reduced cost.

The present invention provides, in one aspect thereof, a cylindrical pump device comprising: a cylindrical housing having central axis of the housing; a cylindrical rotational member received in the cylindrical housing for rotation around the central axis, the cylindrical rotational member including a solid cylindrical wall, a central hub and a plurality of flexible blades each extending from the central hub to the solid cylindrical wall for defining a plurality of liquid chambers therebetween; a shaft supported by the cylindrical housing at a location apart from the central axis for supporting the central hub for rotation; and an inlet port and an outlet port formed in the cylindrical housing and each communicated to at least one of the liquid chambers at a time during rotation of the cylindrical rotational member, whereby each of the liquid chambers increases and decreases its volume to introduce liquid from the inlet port and then discharges the liquid through the outlet port.

The cylindrical pump device according to the present invention does not need a pair of valves such as used in association with the plunger pump for avoiding leakage of the liquid.

The cylindrical pump device according to the present invention can be suitably used in an ink jet recording head for discharging bubbles from an ink jet recording head without the need to incorporate a pair of valves, thereby simplifying the structure of the ink jet recording device.

The above and other objects, features and advantages of the present invention will be more apparent from the following description, referring to the accompanying drawings.

PREFERRED EMBODIMENTS OF THE INVENTION

Figure 1:
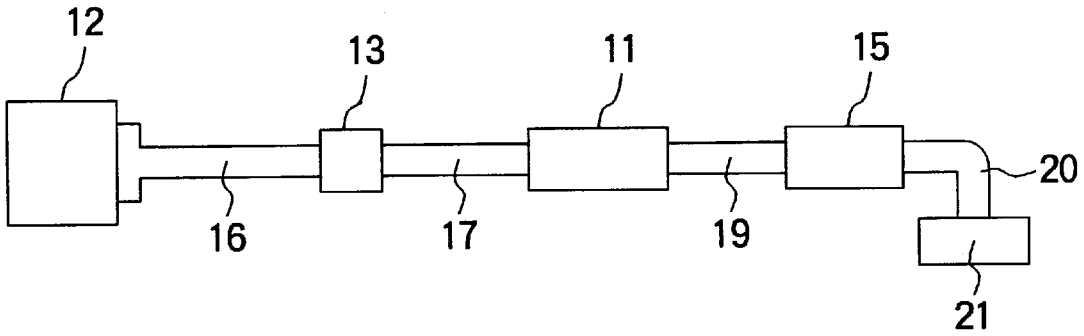
FIG. 1 PRIOR ART
FIG. 1 is a block diagram of a conventional pump system in an ink jet recording device.

Now, the present invention will be more specifically described based on preferred embodiments thereof with reference to the accompanying drawings wherein similar constituent elements are designated by the same reference numerals throughout the drawings.

Figure 2:
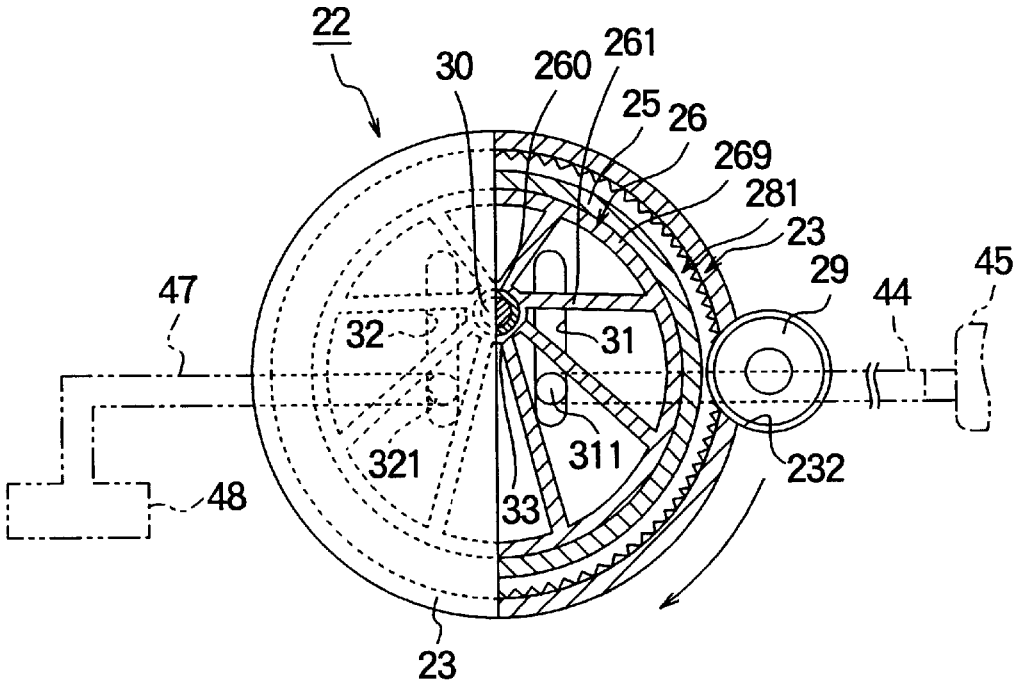
FIG. 2 is a partially sectioned rear view of a cylindrical pump device according to a first embodiment of the present invention.
Figure 3:
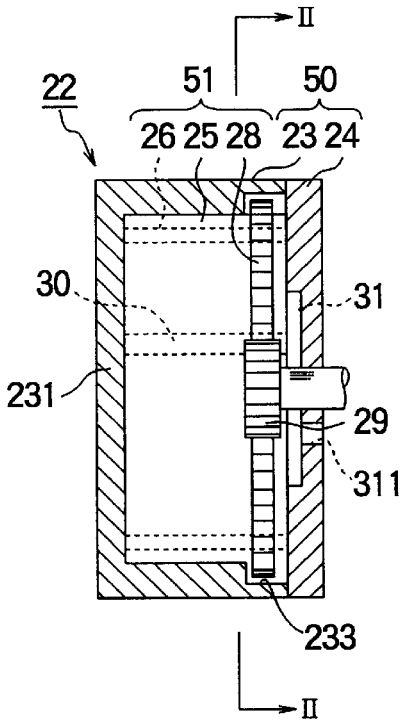
FIG. 3 is a partially sectioned side view of the cylindrical pump device of FIG. 2.

FIGS. 2 and 3 show a cylindrical pump device according to a first embodiment of the present invention, the figure of the pump depicted at a right side half of FIG. 2 being taken along line II—II in FIG. 3. The cylindrical pump device generally designated at numeral 22 comprises a cylindrical housing 50 including a cylindrical cup body 23 having a closed bottom 231 and a top opening, and a cover plate 24 for closing the top opening of the cup body 23, and a cylindrical rotational member 51 rotatably received in the cylindrical housing 50. The cup body 23 has a larger diameter portion 233 adjacent to the cover plate 24, for receiving a gear plate 28 of the rotational member 51 adjacent to the cover plate 24.

Figure 4:
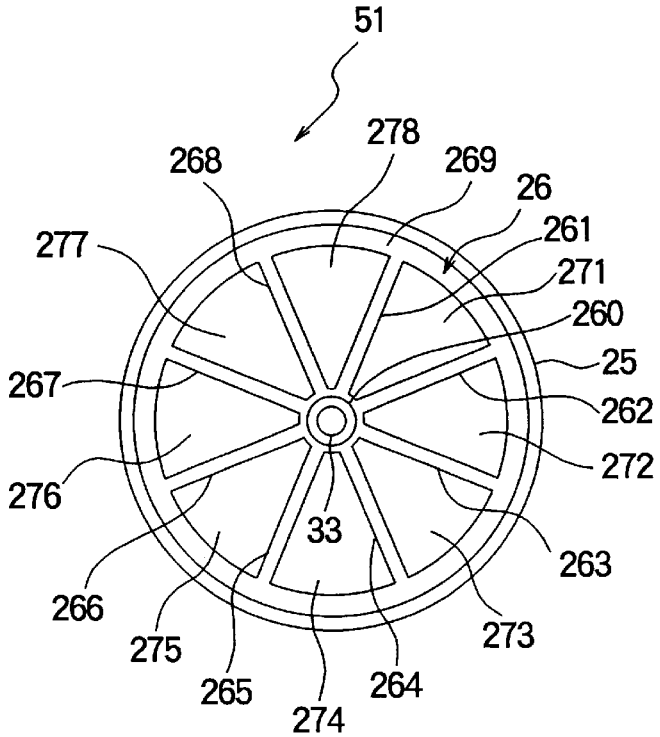
FIG. 4 is a front view of the rotational member in the cylindrical pump device of FIG. 2, shown as it is left alone.
Figure 5:
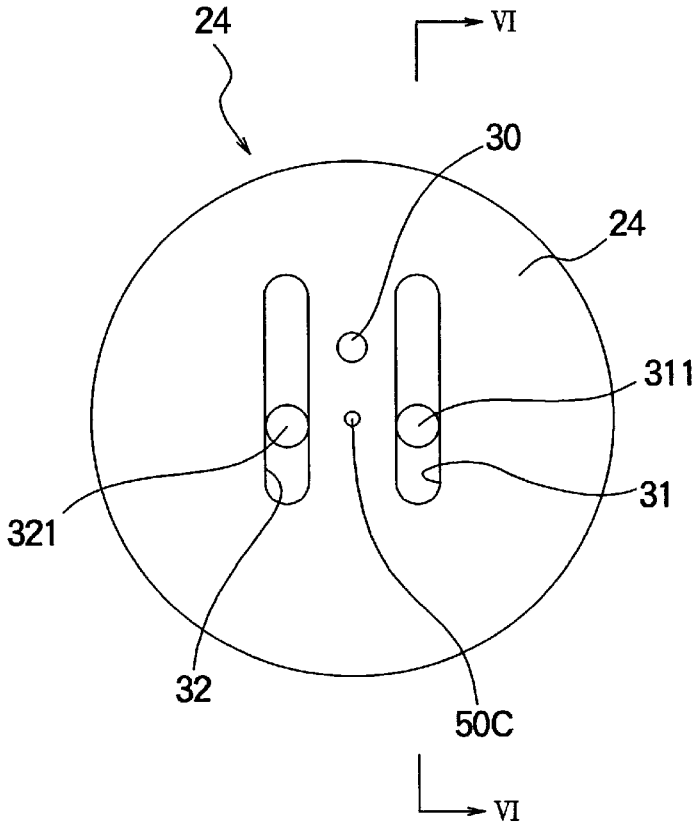
FIG. 5 is a front view of the cover plate shown in FIGS. 2 and 3.
Figure 6:
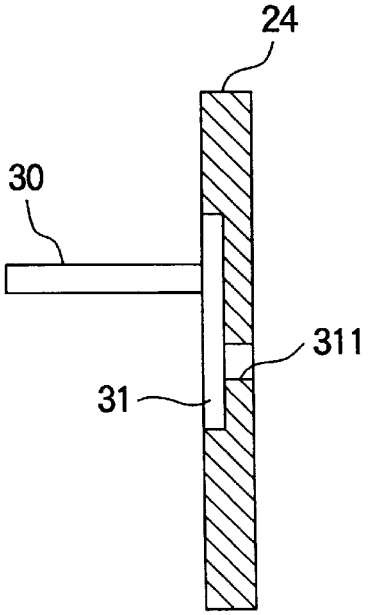
FIG. 6 is a cross-sectional view taken along line VI—VI in FIG. 5.

Referring to FIG. 4 showing the rotational member 51 as it is left alone, the rotational member 51 includes a solid cylindrical wall 25 made of a metal, for example, a flexible blade member 26 made of a resilient material received in the solid cylindrical wall 25, and a driven gear (28 shown in FIGS. 2 and 3) fixed to the solid cylindrical wall 25. The flexible blade member 26 has a cylindrical wall portion 269 having an outer diameter substantially equal to the inner diameter of the solid cylindrical wall 25 and attached thereto by an adhesive, for example, a central hub portion 260 receiving a solid slot member 33 therein for receiving a shaft, and a plurality of (eight, in this example) blades 261 to 268 each extending radially outside from the central hub 260 to the wall portion 269 for defining a plurality of liquid chambers 271 to 278 therebetween for receiving liquid therein Referring to FIGS. 5 and 6, the cover plate 24 is formed as a disk having a diameter substantially equal to the diameter of the gear plate 28. The cover plate 24 rotatably supports the shaft 30, which is disposed apart from the center 50C of the cylindrical housing 50 and herein called eccentric shaft 30. Alternatively, the shaft 30 may be supported by the cylindrical housing 50 at a location apart from the center 50C. The eccentric shaft 30 is inserted to the slot member 33 for supporting the flexible blade member 26 for rotation around the center 50C of the cylindrical housing 50.

The cover plate 24 has an inlet channel 31 and an outlet channel 32 opposing each other on the inner surface of the cover plate 24, with the eccentric shaft 30 disposed therebetween. Each of the inlet channel 31 and outlet channel 32 extends substantially parallel to a line passing through the center 50C of the cylindrical housing 50 and the center of the eccentric shaft 30. The inlet channel 31 and outlet channel 32 are apart from each other so that both the channels 31 and 32 are not communicated to the same chamber of the blade member 26 at a time. The inlet channel 31 and outlet channel 32 are communicated to an inlet port 311 and outlet port 321, respectively, both penetrating the cover plate 24.

Referring back to FIG. 2, the inlet port 311 is communicated to an ink jet recording head 45 through an inlet tube 44, whereas the outlet port 321 is communicated to an ink reservoir 48 through an outlet tube 47. A driving gear 29 is disposed adjacent to the cylindrical housing 50 to enter therein through a cut-out 232 of the cup body 23 for driving the gear plate 28 of the rotational member 51 around the central axis of the cylindrical housing 50. The solid cylindrical wall 25 has an outer diameter substantially equal to the inner diameter of the cylindrical cup body 23 and a height substantially equal to the depth of the cylindrical cup body 23. When the gear plate 28 of the cylindrical rotational member 51 is driven by the driving gear 29 at the cogged edge 281, the cylindrical rotational member 51 rotates so that the side wall, bottom and the top of the cylindrical rotational member 51 slide on the inner surfaces of the cover plate 24 and the cylindrical cup body 23.

Figure 7:
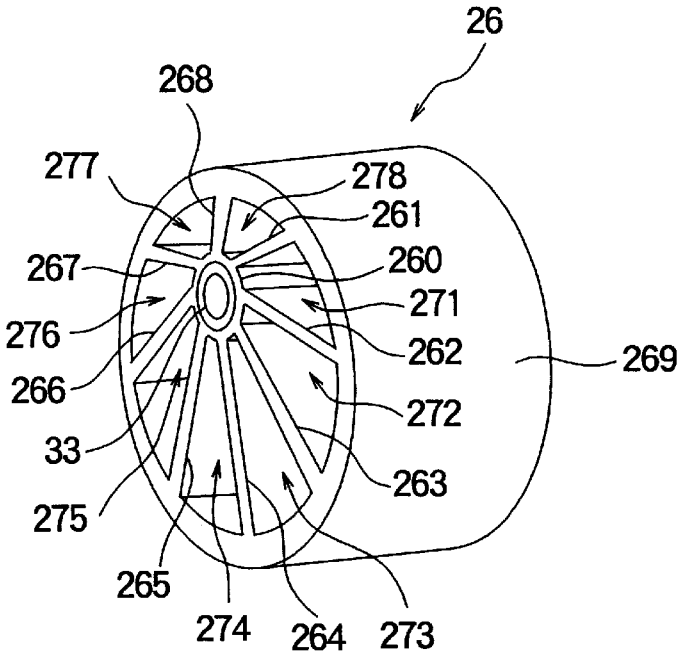
FIG. 7 is a perspective view of the flexible blade member when installed in the cylindrical housing.

FIG. 7 shows the flexible blade member 26 after the rotational member 51 is installed in the cylindrical housing 50. In assembly of the cylindrical pump device 22 of the present embodiment, the eccentric shaft 30 is inserted into the slot member 33 of the hub 260 of the flexible blade member 26 after the rotational member 51 is installed within the cup body 23. Thus, the hub 260 is positioned apart from the center of the flexible blade member 26 as shown in the drawing, wherein blades 263, 264 and 265 are expanded, the blades 267, 268 and 261 are contracted, and blades 262 and 267 are deviated in the direction thereof. The cover plate 24 is then attached to the opening of the cup body 23 for sealing. The configuration of the flexible blade member 26 allows the liquid chambers 271 and 278 located far from the center of the housing 50 to have a reduced volume, and allows the chambers 272 to 275 located near the center of the housing 50 to have a enlarged volume.

Figure 8:
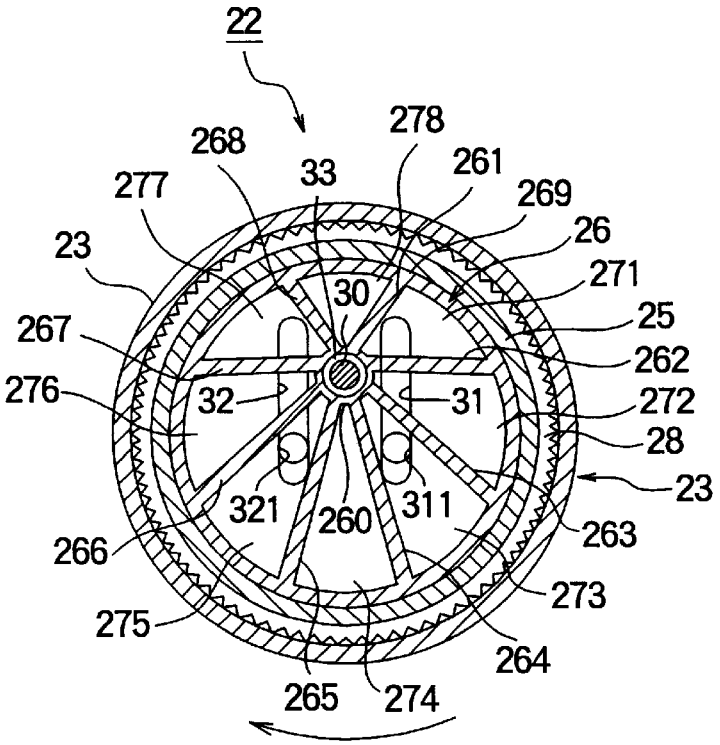
FIG. 8 is a vertical-sectional view of the cylindrical pump device of FIG. 2 during rotation of the rotational member.

Referring to FIG. 8, in operation of the cylindrical pump device according to the present embodiment, the gear of the cylindrical rotational member is driven by the driving gear to rotate the rotational member in the clockwise direction as shown by an arrow. Chamber 278 shown at the top in FIG. 8 has a minimum volume among chambers 271 to 278. During the clockwise rotation of the rotational member, chamber 278 increases its volume so that chamber 278 is subjected to a negative pressure to thereby introduce liquid through the inlet channel 31 until chamber 278 is positioned at the location of chamber 273 shown in the vicinity of the bottom in the drawing. Chamber 278 is further rotated in the clockwise direction to reduce its volume so that chamber 278 is subjected to a positive pressure to discharge the liquid through the outlet channel 32 until chamber 278 is located at the position of chamber 277 shown in the vicinity of the top in the drawing.

Similarly, during the rotation, other chambers are subjected to a negative pressure to introduce therein the liquid from the inlet port 311, and then subjected to a positive pressure to discharge the liquid from the outlet port 321, which are repeated so long as the rotational member rotates. One rotation of the rotational member corresponds to one cycle of the pump for pumping the liquid. In this configuration, ink leakage does not occur during operation of the pump between the inlet port 311 and outlet port 321 without providing valves therfor. Thus, reduction of the number of parts can be achieved from the conventional pump system, and changeover of the valves are no longer necessary in the present embodiment.

Figure 9:
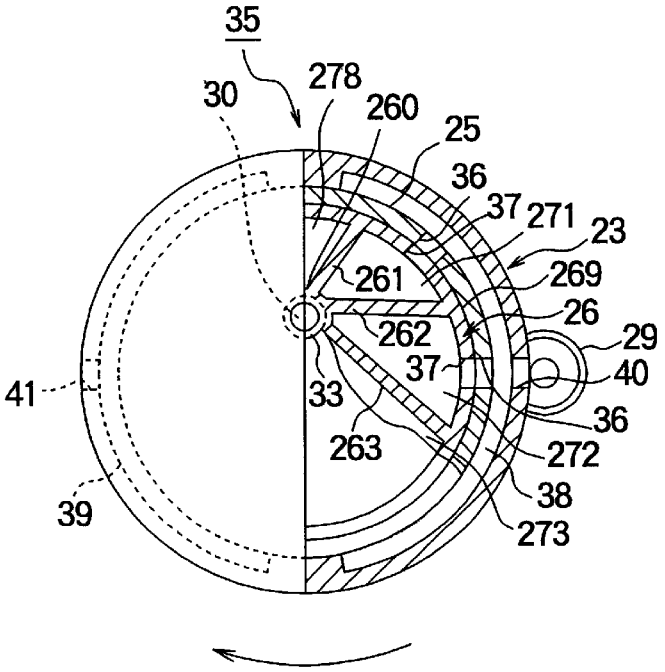
FIG. 9 is a partially sectioned rear view of a cylindrical pump device according to a second embodiment of the present invention.
Figure 10:
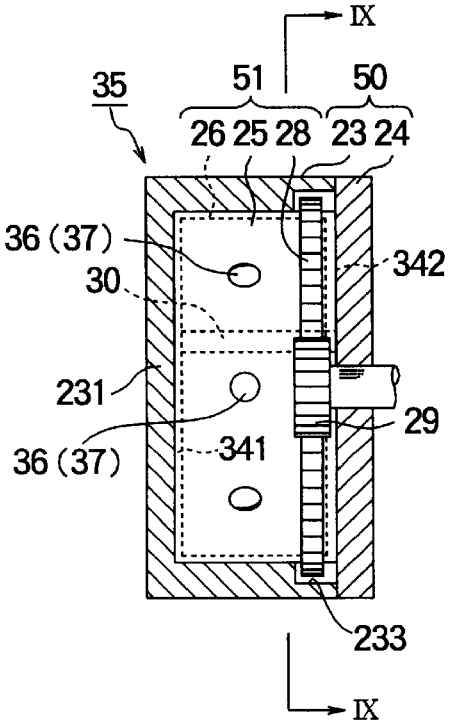
FIG. 10 is a schematic side view of the cylindrical pump device of FIG. 9.
Figure 11:
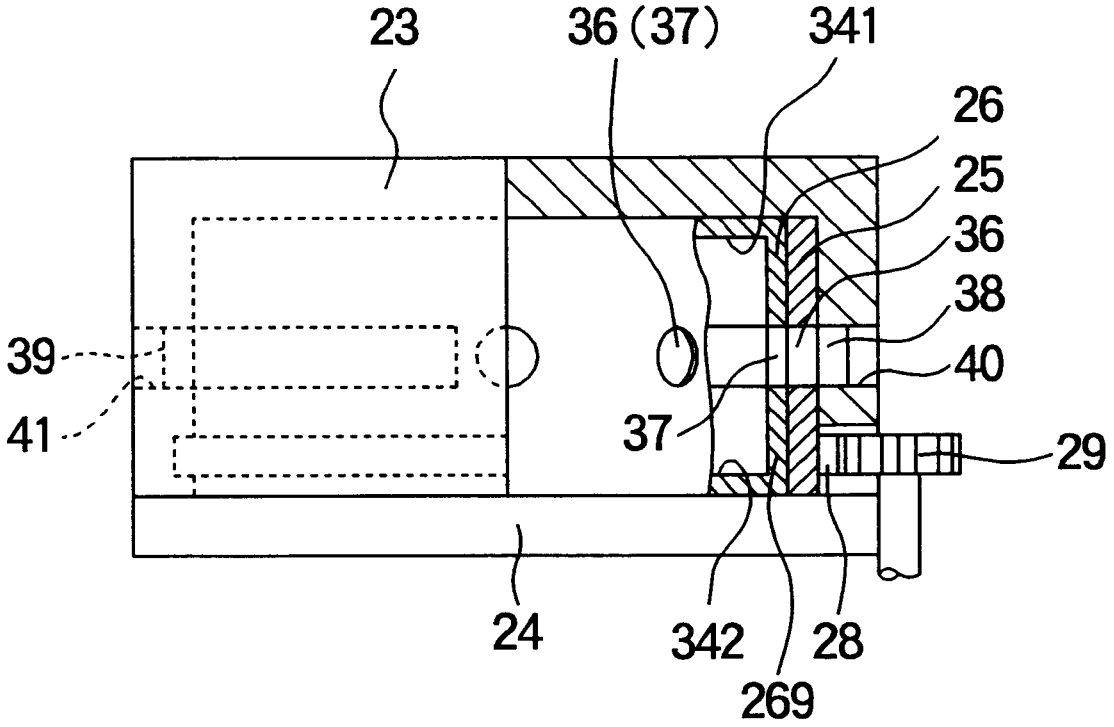
FIG. 11 is a partially sectioned bottom view of the cylindrical pump device of FIG. 9.

FIGS. 9 and 10 show a cylindrical pump device according to a second embodiment of the present invention, similarly to FIGS. 2 and 3, respectively. FIG. 11 is a bottom view of the pump device of FIG. 9. The second embodiment is similar to the first embodiment except for the configuration of the flexible blade member and the liquid passages. Specifically, the flexible blade member 26 has a cylindrical wall 269, a central hub 260, eight blades 261 to 268, a closed bottom 341 and a closed top 342 for defining the eight chambers 271 to 278 by the flexible blade member 26 alone. The flexible blade member 26 has a port 37 for each of the chambers 271 to 278 at the center of the cylindrical wall 269 as viewed along the axis of the cylinder. The solid cylindrical wall 25 of the rotational member 51 also has a port 36 corresponding to each of the ports 37 of the flexible blade member 26.

The cylindrical housing 50 has an inlet port 40 and an outlet port 41 both disposed in the cylindrical wall of the cylindrical cup body 23 and opposed to each other in symmetry with respect to the center of the cylindrical housing 50.

Between the cylindrical rotational member 51 and the cylindrical cup body 23 are disposed a first and a second arcuate liquid passages 38 and 39 extending along substantially half the cylindrical surface of the cylindrical housing 51. The first and second arcuate liquid passages 38 and 39 are communicated to the inlet port 40 and outlet port 41, respectively, for introduction of liquid ink. Each of the first and second arcuate passages 38 and 39 is communicated to less than a half (three, in this example) of the chambers 271 to 278 of the flexible blade member 26 at a time through the corresponding ports 36 and 37 formed in the cylindrical wall of the rotational member 51.

In operation of the second embodiment, each chamber of the flexible blade member 26 is periodically enlarged and reduced in its volume, similarly to the first embodiment, to pump the liquid ink from the ink jet recording head through the inlet port 40 to the reservoir through the outlet port 41. Specifically, during rotation of the rotational member, liquid ink is introduced from the ink jet recording head through the inlet port 40, inlet passage 38, each of the ports 36 and ports 37 of the rotational member 51 to each of the chambers 271 to 278, and then discharged therefrom through each of the ports 37 and ports 36, outlet passage 39 and outlet port 41 to the ink reservoir.

In the second embodiment, the configuration of the flexible blade member 26 reduces liquid leakage from the pump device to the ambient.

Figure 12:
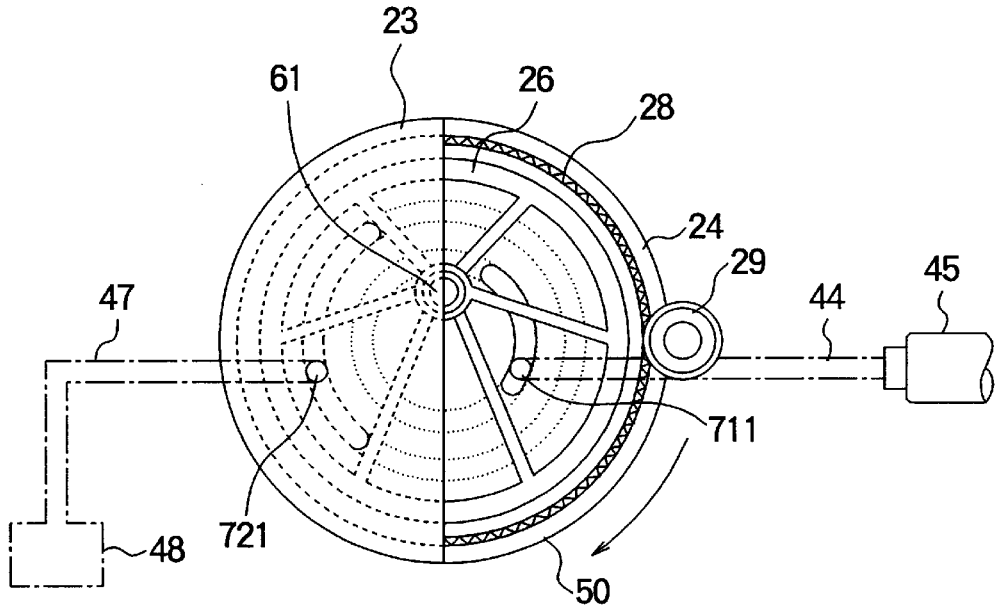
FIG. 12 is a partially sectioned rear view of a cylindrical pump device according to a third embodiment of the present invention.
Figure 13:
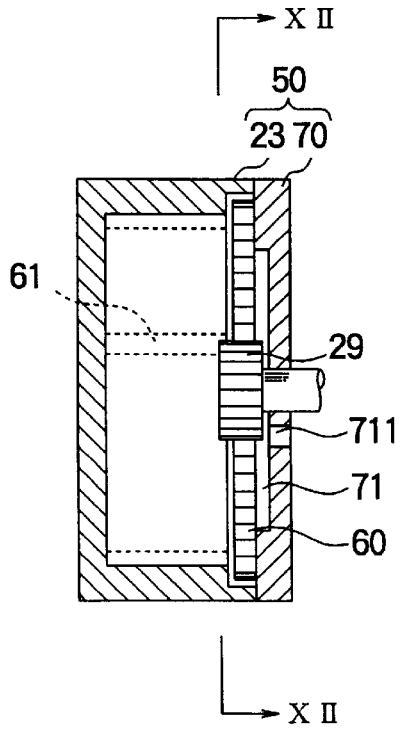
FIG. 13 is a partially sectioned side view of the cylindrical pump device of FIG. 12.

FIGS. 12 and 13 show a cylindrical pump device according to a third embodiment of the present invention, similarly to FIGS. 2 and 3, respectively. The pump device of the present embodiment is similar to the first embodiment except for the revolution of the eccentric shaft 61 and a stationary flexible blade member 26 in the present embodiment. Specifically, the pump device comprises a cylindrical housing 50, a flexible blade member 26 having a wall portion attached to the inner surface of the cylindrical housing 50, and a rotational member 60 including a gear plate 28 and the eccentric shaft 61.

Figure 14:
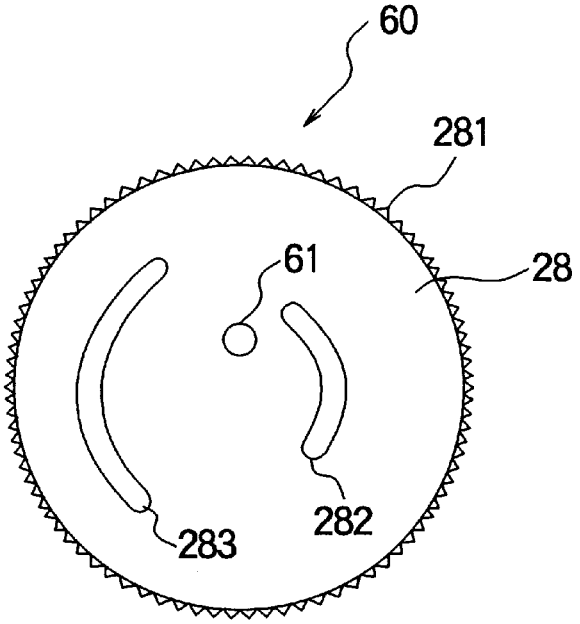
FIG. 14 is a rear view of the rotational member shown in FIG. 12.
Figure 15:
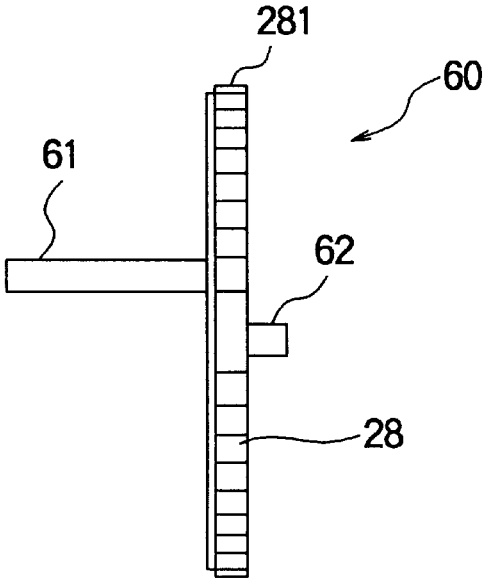
FIG. 15 is a side view of the rotational member of FIG. 14.

Referring to FIG. 14, the rotational member 60 comprises a gear plate 28 having a cogged edge 281, an eccentric shaft 61 extending toward the bottom of the cylindrical housing from the gear plate 28 at a location apart from the center of the gear plate 28, and a shaft extending toward the cover plate 70. The gear plate 28 has a pair of openings including an inlet opening 282 and an outlet opening 283 each of an arcuate shape defined by a center at the center of the gear plate 28. The inlet opening 282 and outlet opening 283 oppose each other with the center of the gear plate 28 being located therebetween. As shown, the outlet opening 283 is disposed radially outside the inlet opening 282.

Figure 16:
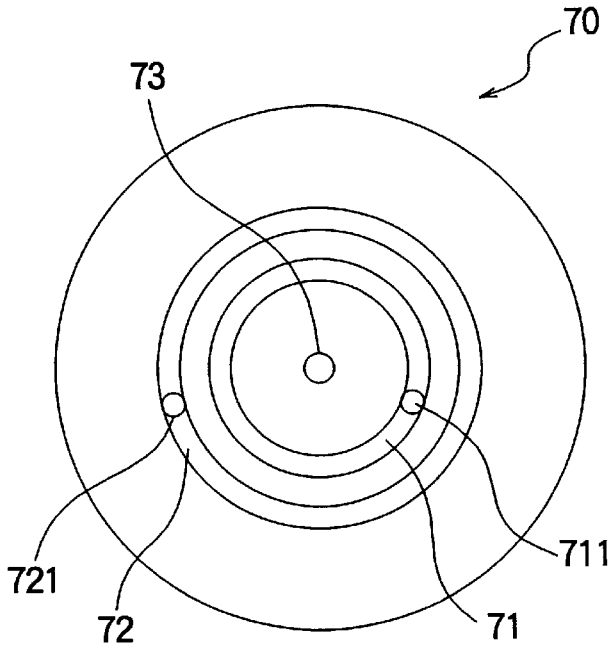
FIG. 16 is a rear view of the cover plate shown in FIG. 12.

Referring to FIG. 16, the cover plate 70 has a bearing hole 73 for receiving the shaft 62 of the rotational member 60, a combination of inlet port 711 and inlet channel 71 both disposed corresponding to the inlet opening 282 of the rotational member 60, and a combination of outlet port 721 and outlet channel 72 both disposed corresponding to the outlet port 283 of the rotational member 60. Each of the ports 711 and 721 penetrates the cover plate 70 whereas each of the channels 71 and 72 is formed on the inner surface of the cover plate 70. Other configurations are similar to those in the first embodiment.

Figure 17:
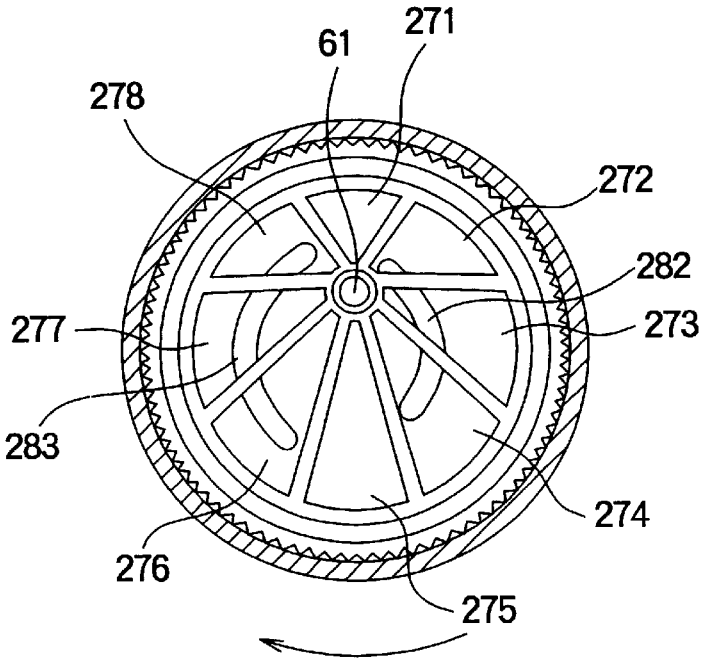
FIG. 17 is a vertical-sectional view of the cylindrical pump device of FIG. 12 during rotation of the rotational member.

Referring to FIG. 17, the rotational member is driven for rotation by the driving gear to revolve the eccentric shaft 61 around the center of the cylindrical housing 50. During the revolution of the eccentric shaft 61, each of the chambers 271 to 278 increases and decreases its volume to introduce liquid ink through the inlet port and discharges the liquid ink through the outlet port.

Specifically, chamber 271 shown at the top in FIG. 17 has a minimum volume and increases its volume during the clockwise revolution of the eccentric shaft 61 to thereby introduce liquid ink through the inlet port 282 until the eccentric shaft reaches the bottom, whereas chamber 275 shown at the bottom in FIG. 17 has a maximum volume and reduces its volume during the revolution of the eccentric shaft 61 to thereby discharge the liquid ink in the chamber 275 through the outlet port 283 until the eccentric shaft reaches the bottom.

Although the present invention is described with reference to preferred embodiments thereof, the present invention is not limited to the specific embodiments and various modifications or alterations can be made by those by skilled in the art without departing from the scope of the present invention.

What is claimed is:

1. A cylindrical pump device comprising: a cylindrical housing having a central axis and inner surfaces thereof; a cylindrical rotational member received in said cylindrical housing for rotation around the central axis, said cylindrical rotational member including a solid cylindrical wall, a central hub and a plurality of flexible blades each extending from said central hub to said solid cylindrical wall for defining a plurality of chambers therebetween; a shaft provided within said cylindrical housing at a location apart from the central axis for rotation of said cylindrical rotational member about said central hub, wherein at least one surface of said cylindrical rotational member slides against at least one inner surface of said cylindrical housing during rotation; and an inlet port and an outlet port each communicated to at least one of said chambers at a time during rotation of said cylindrical rotational member, whereby each of said chambers increases and decreases its volume during rotation of said cylindrical rotational member to introduce liquid through said inlet port and to discharge liquid through said outlet port.

2. A cylindrical pump device as defined in claim 1 further comprising a pair of channels corresponding to said inlet port and outlet port, respectively, each of said pair of channels being disposed between said inlet port or outlet port and n said chambers at a time during said rotation, wherein n represents a positive integer less than half the number of said chambers.

3. A cylindrical pump device as defined in claim 1 wherein said cylindrical housing comprises a cylindrical surface and at least one base surface, and wherein said inlet port and outlet port are located on a base surface of said cylindrical housing and opposite to each other with respect to said shaft.

4. A cylindrical pump device as defined in claim 1 wherein said solid cylindrical wall includes a first wall made of a solid material and a second wall made of a flexible material attached to said first wall.

5. A cylindrical pump device as defined in claim 1 wherein said cylindrical housing comprises a cylindrical surface and a base surface, and wherein said inlet port and outlet port are located on said base surface of said cylindrical housing and opposite to each other with respect to said shaft.

6. A cylindrical pump device comprising: a cylindrical housing having a central axis thereof; a cylindrical rotational member received in said cylindrical housing for rotation around the central axis, said cylindrical rotational member including a solid cylindrical wall, a central hub and a plurality of flexible blades each extending from said central hub to said solid cylindrical wall for defining a plurality of chambers therebetween; a shaft provided within said cylindrical housing at a location aprat from the central axis for rotation of said cylindrical rotation memeber about said central hub; an inlet port and an outlet port each communicated to at least one of said chambers at a time during rotation of said cylindrical rotational member, whereby each of said chambers increases and decreases its folume during rotation of said cylindrical rotational member to introduce liquid through said inlet port and to discharge liquid through said outlet port; and a driving gear in the vicinity of said cylindrical housing, wherein said cylindrical rotational member has a driven gear disposed in association with said driving gear for said rotation.

7. A cylindrical pump device comprising: a cylindrical housing having a central axis thereof; a cylindrical rotational member received in said cylindrical housing for rotation around the central axis, said cylindrical rotational member including a solid cylindrical wall, a central hub and a plurality of flexible blades each extending from said central hub to said solid cylindrical wall for defining a plurality of chambers therebetween; a shaft provided within said cylindrical housing at a location apart from the central axis for rotation of said cylindrical rotational member about said central hub; and an inlet port and an outlet port each communicated to at least one of said chambers at a time during rotation of said cylindrical rotational member, whereby each of said chambers increases and decreases its volume during rotation of said cylindrical rotational member to introduce liquid through said inlet port and to discharge liquid through said outlet port; wherein a pair of passages communicated to a plurality of said chambers are formed between an inner surface of said cylindrical housing and an outer surface of said solid cylindrical wall, said pair of passages being communicated to said inlet port and outlet port, respectively.

8. A cylindrical pump device as defined in claim 7 wherein said solid cylindrical wall has a port for each of said chambers for communication between each of aid chambers and said pair of passages.

9. A cylindrical pump device comprising: a cylindrical housing having a central axis and inner surfaces thereof; a rotational member received in said cylindrical housing for rotation around the central axis, wherein at least one surface of said rotational member slides against at least one inner surface of said cylindrical housing during rotation, said rotational member including an eccentric shaft extending parallel to and apart from the central axis, a blade member having a hub attached to said eccentric shaft and a plurality of flexible blades each extending radially outside from said hub to said cylindrical housing for defining a plurality of chambers therebetween; and an inlet port and an outlet port each communicated to at least one of said chambers at a time during rotation of said rotational member, whereby each of said chambers increases and decreases its volume during rotation of said rotational member to introduce liquid through said inlet port and to discharge liquid through said outlet port.

* * * * *